US005186448A

United States Patent [19]

Ohsawa et al.

[11] Patent Number: 5,186,448

[45] Date of Patent: Feb. 16, 1993

[54] SHEET FEEDING APPARATUS

[75] Inventors: Ichiro Ohsawa, Yokohama; Yutaka Kikuchi, Kawasaki; Masanobu Kanoto, Tokyo, all of Japan; Hideki Sato, Glen Cove, N.Y.; Yoshifumi Endo, Kawasaki; Hideshi Kawaguchi, Yokohama, both of Japan

[73] Assignee: Canon Kabushiki Kaisha, Tokyo, Japan

[21] Appl. No.: 865,753

[22] Filed: Apr. 10, 1992

Related U.S. Application Data

[63] Continuation of Ser. No. 670,488, Mar. 13, 1991, abandoned, which is a continuation of Ser. No. 156,592, Feb. 17, 1988, abandoned.

[30] Foreign Application Priority Data

Feb. 17, 1987 [JP] Japan ..... 62-035136
Feb. 17, 1987 [JP] Japan ..... 62-035139

[51] Int. Cl.[5] ..... B65H 3/52

[52] U.S. Cl. ..... 271/9; 271/10; 271/121

[58] Field of Search ..... 271/9, 10, 110, 111, 271/114, 116, 119, 121, 122, 124, 125, 127

[56] References Cited

U.S. PATENT DOCUMENTS

| | | | |
|---|---|---|---|
| 4,158,456 | 6/1979 | Holland-Letz | 271/122 X |
| 4,386,769 | 6/1983 | Ito | 271/111 X |
| 4,496,145 | 1/1985 | Fukui . | |
| 4,513,956 | 4/1985 | Sigvardt | 271/9 |
| 4,542,896 | 9/1985 | Takahashi | 271/111 |
| 4,565,361 | 1/1986 | Tanaka | 271/121 X |
| 4,602,777 | 7/1986 | Bond | 271/9 |
| 4,627,607 | 12/1986 | Ishii | 271/122 |
| 4,638,987 | 1/1987 | Sakurai | 271/122 X |
| 4,663,722 | 5/1987 | Sato | 271/9 |
| 4,715,597 | 12/1987 | Sakurai | 271/122 |

FOREIGN PATENT DOCUMENTS

| | | | |
|---|---|---|---|
| 0060596A1 | 9/1982 | European Pat. Off. . | |
| 58-63974 | 4/1983 | Japan . | |
| 59-139161 | 2/1984 | Japan . | |
| 2029377A | 3/1980 | United Kingdom . | |
| 2105690 | 3/1983 | United Kingdom | 271/121 |

OTHER PUBLICATIONS

IBM Technical Disclosure Bulletin, vol. 17, No. 4, p. 958, Sep. 1974, Priority Insertion Card Mechanism, R. E. Hunt.

*Primary Examiner*—Richard A. Schacher
*Attorney, Agent, or Firm*—Fitzpatrick, Cella, Harper & Scinto

[57] ABSTRACT

A sheet feeding apparatus includes a feeding roller for feeding a sheet material from a stack of sheet materials, a separation device for cooperating with the feeding roller to allow only one sheet material to be fed, a transportation roller for cooperating with the feeding roller to transport the sheet material separated by the separating device.

31 Claims, 17 Drawing Sheets

SHEET FEEDING APPARATUS

This application is a continuation of application Ser. No. 07/670,488, filed Mar. 13, 1991, now abandoned, which is a continuation of application Ser. No. 07/156,592, filed Feb. 17, 1988, now abandoned.

FIELD OF THE INVENTION AND RELATED ART

The present invention relates to a sheet feeding apparatus usable with an image forming apparatus such as a copying machine and a printer.

Referring to FIG. 1, a conventional sheet feeding apparatus includes a sheet tray 2, a sheet feeding spring 3 and a feeding roller 4, wherein a transfer material 1 on the sheet tray 2 is urged to the feeding roller 4 by the feeding spring 3. When the feeding roller 4 rotates, the leading edge of the transfer material (sheet) 1 is advanced into the space formed between a sheet guide 2' and the feeding roller 4 by friction. The coefficients of friction are so set that when plural transfer materials are advanced, the coefficient of friction $\mu_1$ between the transfer materials 1, the coefficient $\mu_3$ between the feeding roller 4 and the transfer material 1 and the coefficient $\mu_2$ between the transfer material 1 and a separation pad 6 which is urged to the feeding roller 4 by a separation spring 5, satisfy $\mu_1<\mu_2<\mu_3$. Because $\mu_1\mu_2$, the plural sheets are stopped from the one closest to the separation pad 6, and finally, because $\mu_2<\mu_3$, only one transfer material 1*a* is conveyed between the feeding roller 4 and the separation pad 6, as shown in FIGS. 2 and 3. Immediately after the transfer material 1*a* passes between the feeding roller 4 and the separation pad 6, the speed Va of the transfer material (FIG. 1) may varies depending on the relationships among the frictional coefficients $\mu_1$, $\mu_2$ and $\mu_3$, and therefore, the speed is unstable. After the leading edge of the transfer material 1*a* is caught by the couple of the registration rollers 13 and 14, the driving of the feeding roller 4 is stopped.

The feeding roller 4 is provided with an unshown one-way clutch, so that the feeding roller 4 follows to rotate by the friction between the transfer material 1*a* and itself. When the trailing edge of the transfer material 1*a* departs from the feeding roller 4, the rotation of the feeding roller 4 stops, and therefore, the next transfer material 1*b* is not fed. Since the pressure between the registration rollers 13 and 14 is large enough as compared with the frictional load between the transfer material 1*a* and the separation pad 6, the conveying speed Vb of the transfer material 1*a* is stabilized.

On the other hand, a light beam 9 produced in the optical scanning means 8 is imaged on the photosensitive member 10 to form a latent image thereon, which is in turn developed with toner by a developing device. The toner image on the photosensitive member 10 is transferred onto the transfer material 1*a* at point P. The toner image transferred onto the transfer material 1*a* is fixed by a fixing device 12.

The conventional example employs a couple of registration rollers 13 and 14 in order to stabilize the speed of the transfer material at the point P where the image transfer is effected and to provide an accurate image. However, the employment of the registration roller couple makes the apparatus bulky and expensive.

More particularly, the conventional example relies on the relationship between the frictional forces wherein the frictional coefficient (and therefore force) $\mu_3$ the feeding roller 4 and the transfer material 1 is larger than the frictional coefficient (and therefore force) $\mu_2$ between the separation pad and the transfer material when the transfer material or materials are between the feeding roller 4 and the separation pad 6 functioning as a separating means. For this reason, there always exists a slipping between the separation pad 6 and the transfer material 1 to be conveyed. This results in a braking force always applied to the feeding action of the feeding roller 4, and the braking force varies in accordance with materials, thickness and surface property of the transfer sheets and also with the number of sheets involved. Those are the reasons why the feeding speed Va of the feeding roller 4 is not stabilized. In order to obviate those problems, the conventional example uses a couple of registration rollers 13 and 14 between the feeding roller 4 and the transfer drum 10 so as to stabilize the feeding speed Vb at a position where the stabilized speed is required, for example, the transfer station P where an image is transferred from the photosensitive drum 10 to the transfer material. However, this makes the apparatus bulky and requires additional means, that is, a driving means for the registration roller couple, with the result that the cost of the apparatus is increased.

Additionally, even in the case that the couple of the registration rollers 13 and 14 is used, the feeding speed Va between the feeding roller 4 and the registration roller couple varies depending on the frictional coefficient of the transfer sheets or on the ambient conditions, even to such an extent that the sheet does not reach the registration roller couple in time.

SUMMARY OF THE INVENTION

Accordingly, it is a principal object of the present invention to provide a sheet feeding apparatus by which the feeding of the sheet material is stably and reliably performed, despite the simplified structure of the apparatus.

According to an embodiment of the present invention, there is provided a sheet feeding apparatus, comprising: a feeding rotatable member for feeding a sheet material from a stack of sheet materials; separation means for cooperating with said feeding rotatable member to allow only one sheet material to be fed; and a transporting rotatable member for cooperating with said feeding rotatable member to transport the sheet material separated by said separating means.

Immediately after one transfer sheet is separated out, the speed of the sheet reaches a regular level by the cooperation between the feeding roller and the transporting roller. An additional advantage is that the structure is simplified, since the feeding roller is used for two functions.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
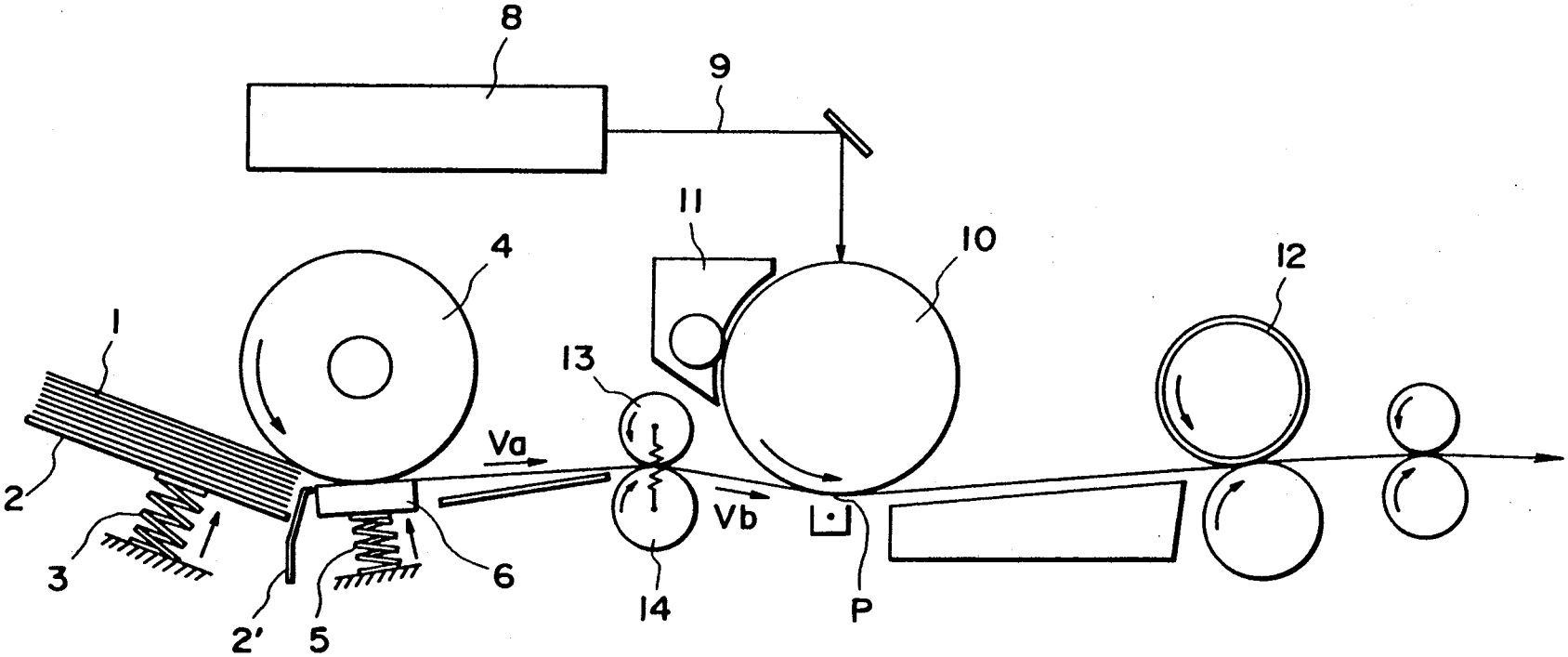
FIG. 1 is a sectional view of a conventional sheet feeding apparatus.
Figure 2:
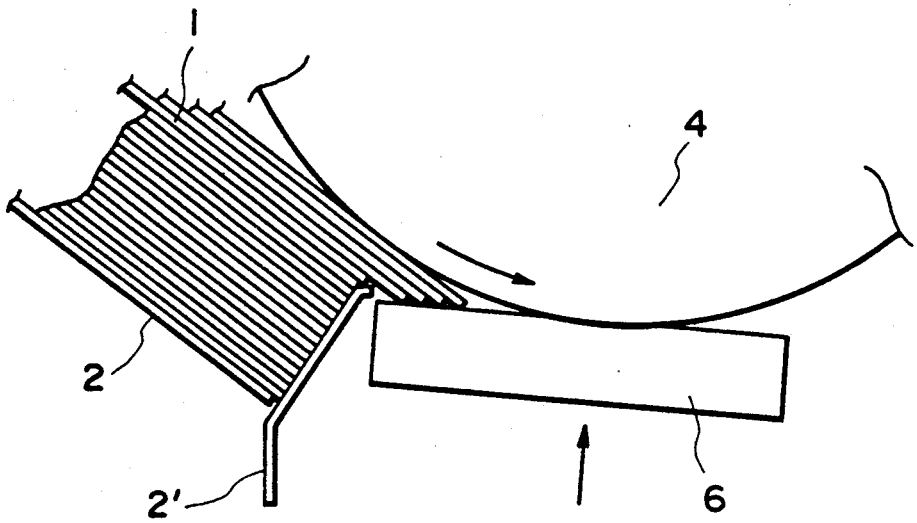
FIG. 2 is an enlarged sectional view around a feeding roller.
Figure 3:
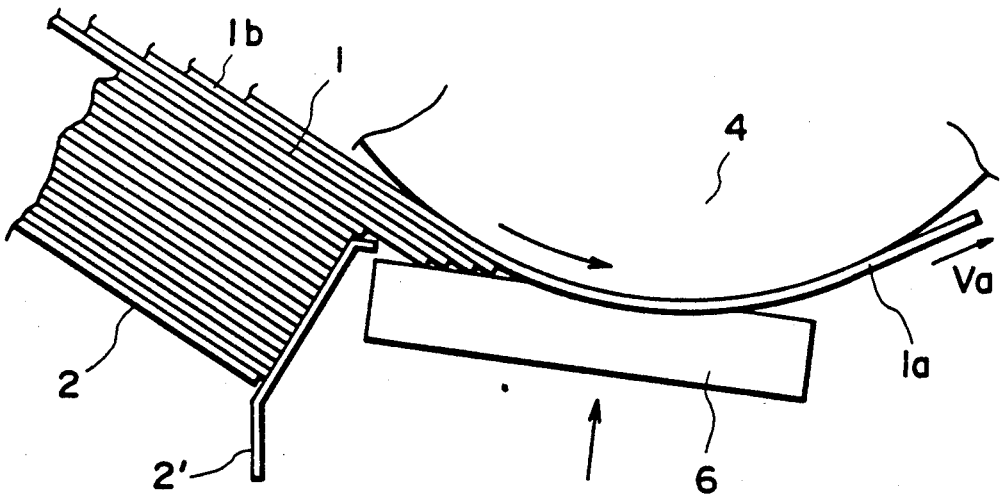
FIG. 3 is an enlarged sectional view around the feeding roller wherein a sheet is being fed.
Figure 4:
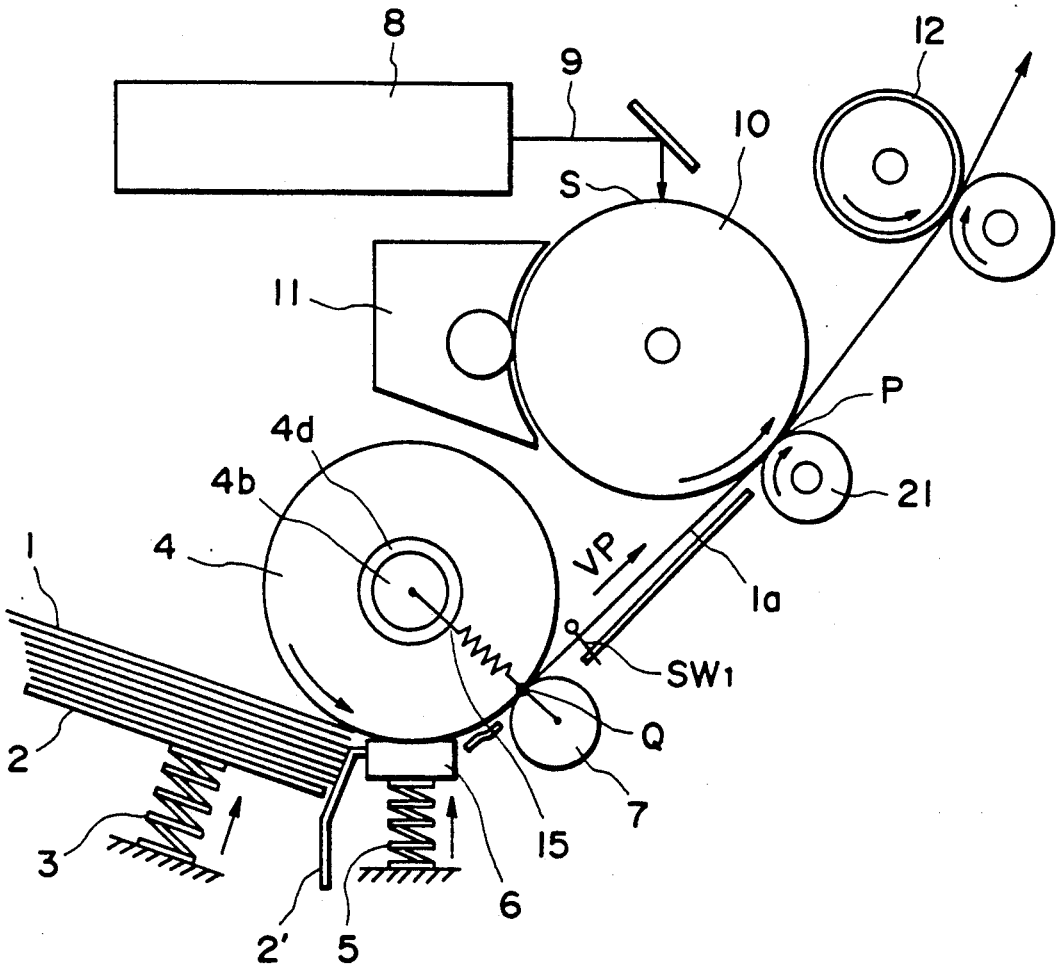
FIG. 4 is a sectional view of a sheet feeding apparatus according to an embodiment of the present invention.
Figure 5:
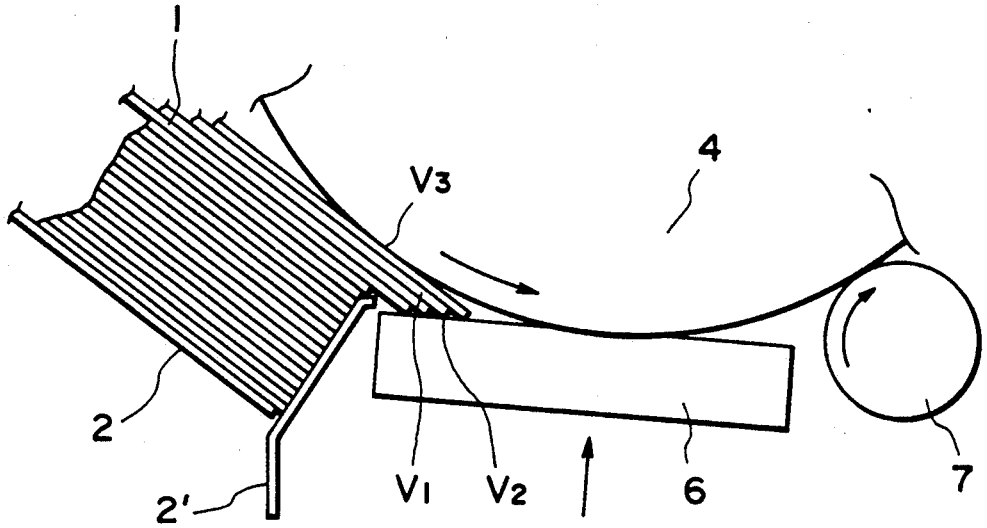
FIG. 5 is an enlarged sectional view around the feeding roller of the apparatus shown in FIG. 4.
Figure 6:
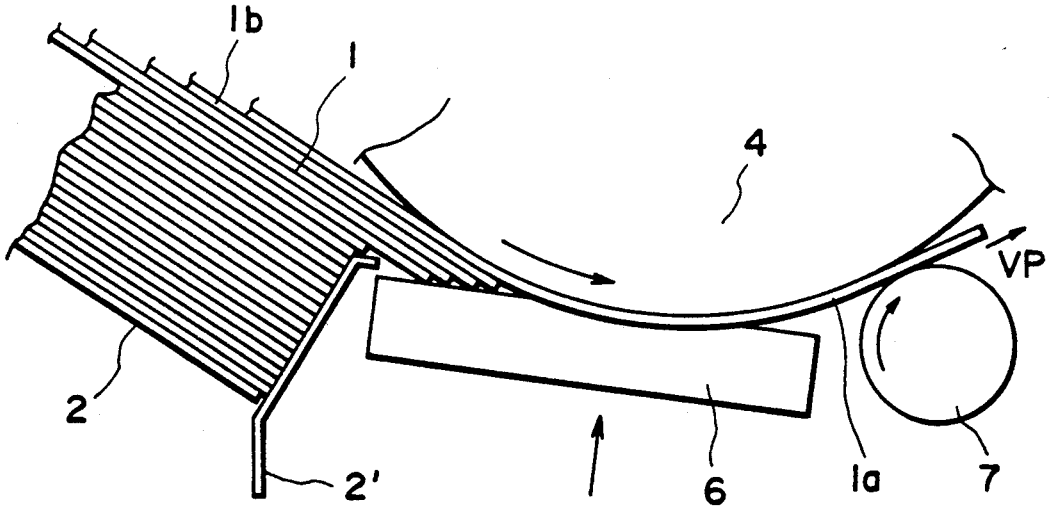
FIG. 6 is an enlarged sectional view around the feeding roller of the apparatus shown in FIG. 4.

Referring to FIG. 4, there is shown a sheet feeding apparatus according to an embodiment of the present invention, wherein a reference numeral 1 designates transfer materials (sheets) which are stacked on a feeding tray 2 and which are to be fed from the tray 2. The transfer materials 1 on the feeding tray 2 is urged to a feeding roller 4 by a feeding spring 3. When the feeding roller 4 rotates, the leading edge of the transfer material 1 advances to the sheet guide 2' by friction. The friction coefficients are such that the friction coefficient $\mu_1$ between plural transfer materials fed out of the tray 2, the friction coefficient $\mu_3$ between the feeding roller 4 and the transfer material 1 and the friction coefficient $\mu_2$ between the transfer material 1 and the separation pad 6 urged to the feeding roller 4 by a separation spring 5 satisfy $\mu_1<\mu_2<\mu_3$. Because of the relation, $\mu_1<\mu_2$, the feeding stops from the closest one to the separation pad 6, when plural transfer materials 1 are fed out; and finally, due to the relation $\mu_2<\mu_3$, only one transfer material 1*a* is passed through between the feeding roller 4 and the separation pad 6, and it reaches a roller 7 which is urged to the feeding roller 4 and which follows the rotation of the feeding roller 4, where the transfer sheet 1*a* is conveyed by the cooperation between the feeding roller 4 and the transporting or conveying roller 7 (FIGS. 5 and 6). Since the pressure between the roller 7 and the feeding roller 4 is sufficiently larger than the frictional load between the transfer material 1*a* and the separation pad 6 to stabilize the conveying speed Vp of the transfer material 1*a* after the transfer material 1*a* is gripped by the nip formed between the feeding roller 4 and the roller 7.

On the other hand, a light beam 9 produced in the optical scanning means 8 is projected onto a photosensitive member 10 surface to form a latent image thereon, which is in turn developed with toner by a developing device 11. The toner image on the photosensitive member 10 is transferred onto the transfer material 1*a* at point P shown in the Figure. When the transfer material 1*a* is caught by the nip formed between the photosensitive member 10 and the transfer roller 21, the driving force applied to the feeding roller 4 is stopped. The feeding roller 4 is equipped with a one-way clutch bearing 4*d* so that after the driving force to the feeding roller 4 is stopped, the feeding roller 4 follows the transfer material 1*a* to rotate by friction therebetween. When the trailing edge of the transfer material 1*a* passes through a point Q where the feeding roller 4 and the roller 7 are in contact, the feeding roller 4 stops, and the next transfer material lb stops at a position slightly advanced. The toner image on the transfer material 1*a* is fixed by a fixing device 12.

When a predetermined period of time passes after completion of the feeding operation of the transfer material 1*a* by the feeding roller 4, a solenoid 22 (FIG. 7B) is energized to disengage a pawl 22*b* from a projection 4*e* of a cam plate (a clutch Cl is actuated), and simultaneously, the driving of the feeding roller 4 is resumed, so as to feed the next transfer material 1*b* out, and the position shown in FIG. 7C is assumed, again.

By repeating those operations, the third and subsequent sheets are fed out.

Figure 7A:
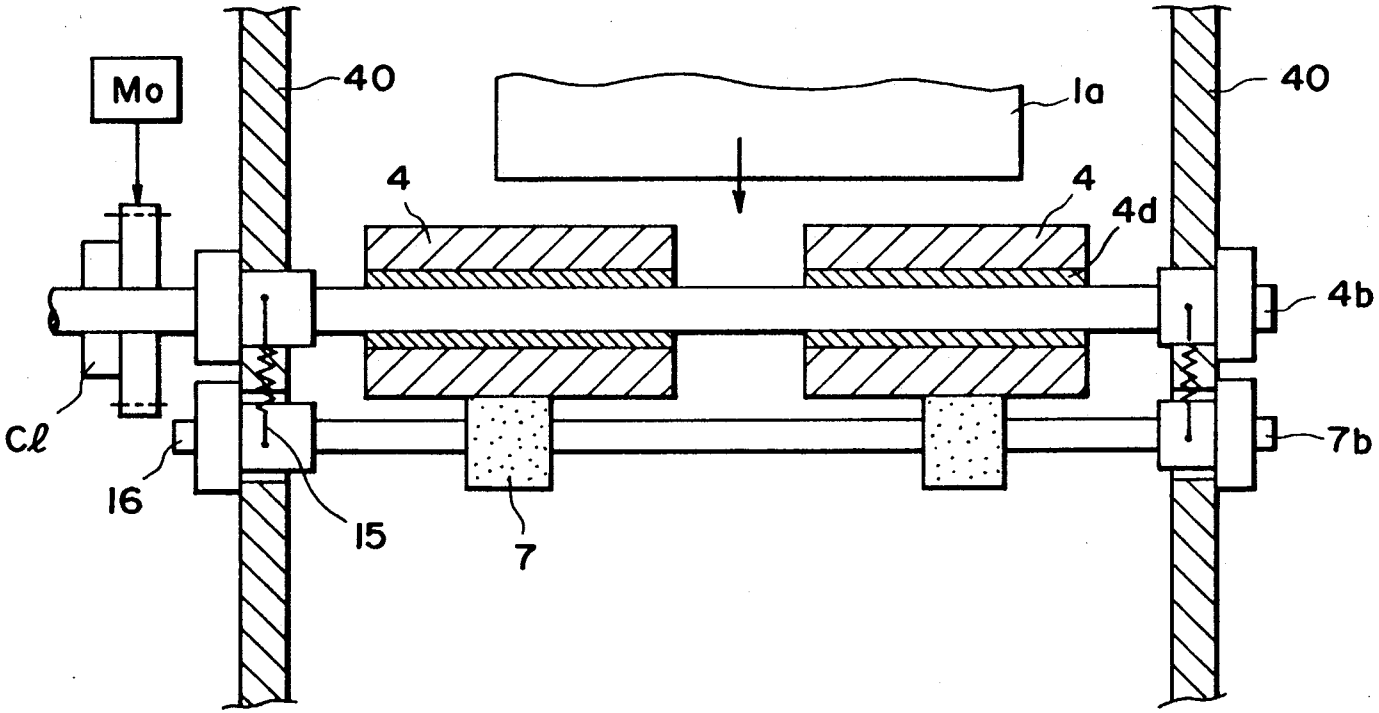
FIG. 7A is a longitudinal sectional view of the feeding roller shown in FIG. 4.
Figure 7B:
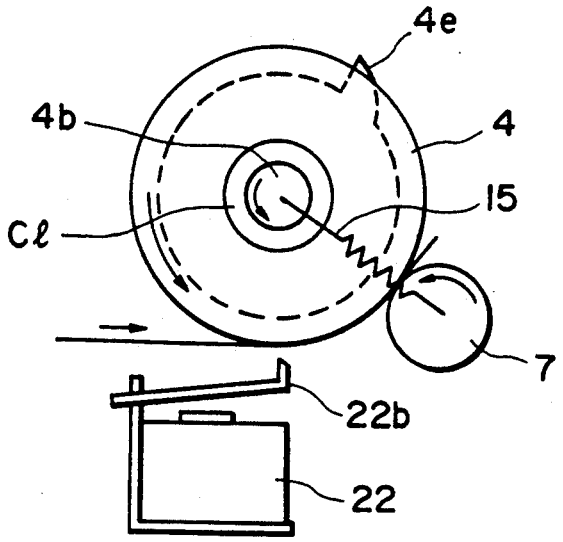
FIGS. 7B and 7C are sectional views of the feeding roller of the feeding apparatus shown in FIG. 4 illustrating contact between the feeding roller and a roller.
Figure 7C:
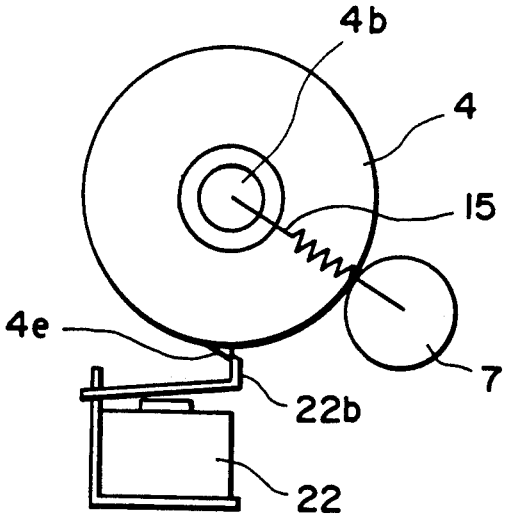

Referring to FIG. 7A, there is shown a longitudinal sectional view of a feeding roller of the apparatus shown in FIG. 4. The rotational force of the feeding roller 4 is transmitted to the roller 7 by pressing the roller 7 to the feeding roller 4 by a station spring 15. The roller 7 is supported on a shaft which is in turn supported by bearings 16 which are supported in side plates 40.

As for a registration means for alignment between the leading edge of the transfer material 1 and the image on the photosensitive member 10, a switch SW1 (FIG. 4) is preferable. More particularly, in response to or with a predetermined delay after the leading edge of the sheet actuating the switch SW1, the writing onto the photosensitive member 10 starts. The timing therebetween is determined by one skilled in the art depending on the distance between the switch SW1 or the point Q and the point P and the distance between a point S of the photosensitive member 10 and the point P.

As an alternative, the timing may be determined using a timer, rather than the switch SW1, which timer starts the timer period at the start of the sheet feeding.

Figure 8:
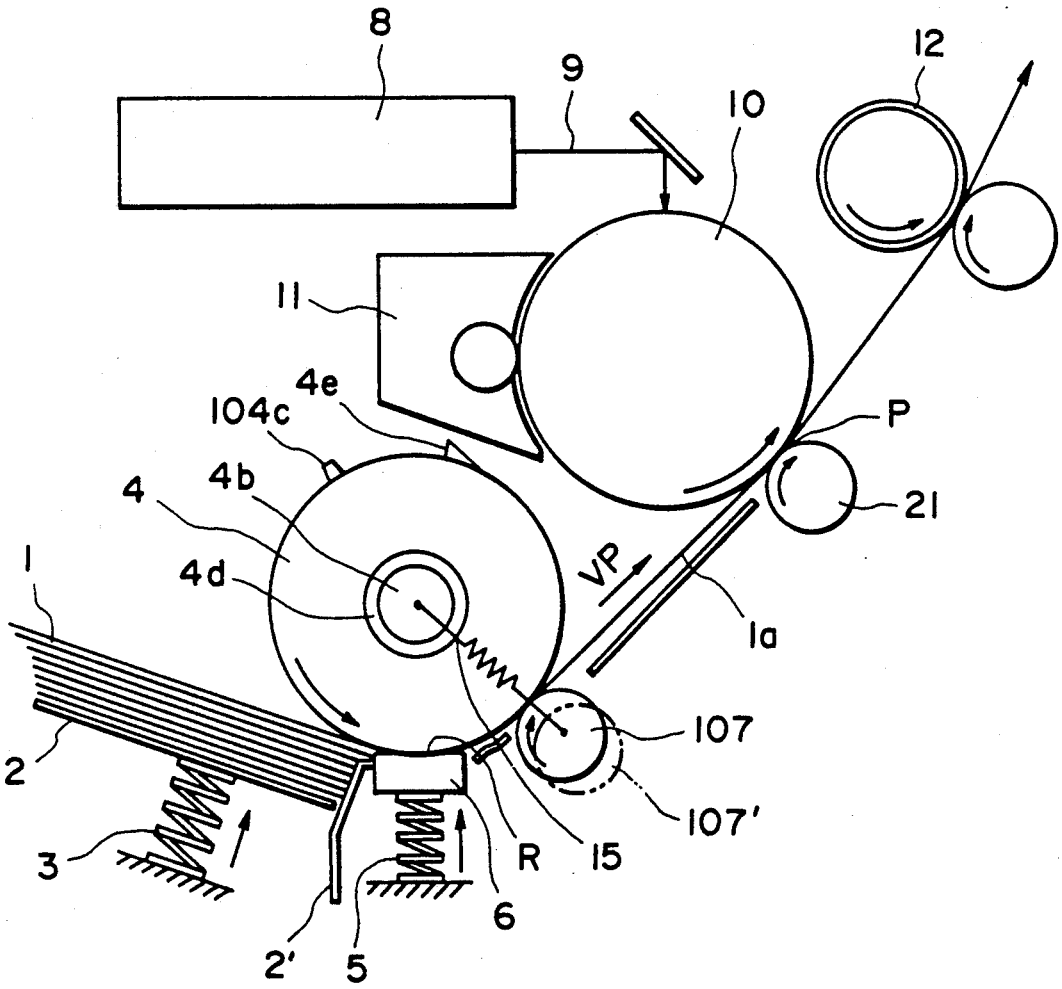
FIG. 8 is a sectional view of a sheet feeding apparatus according to another embodiment of the present invention.
Figure 9:
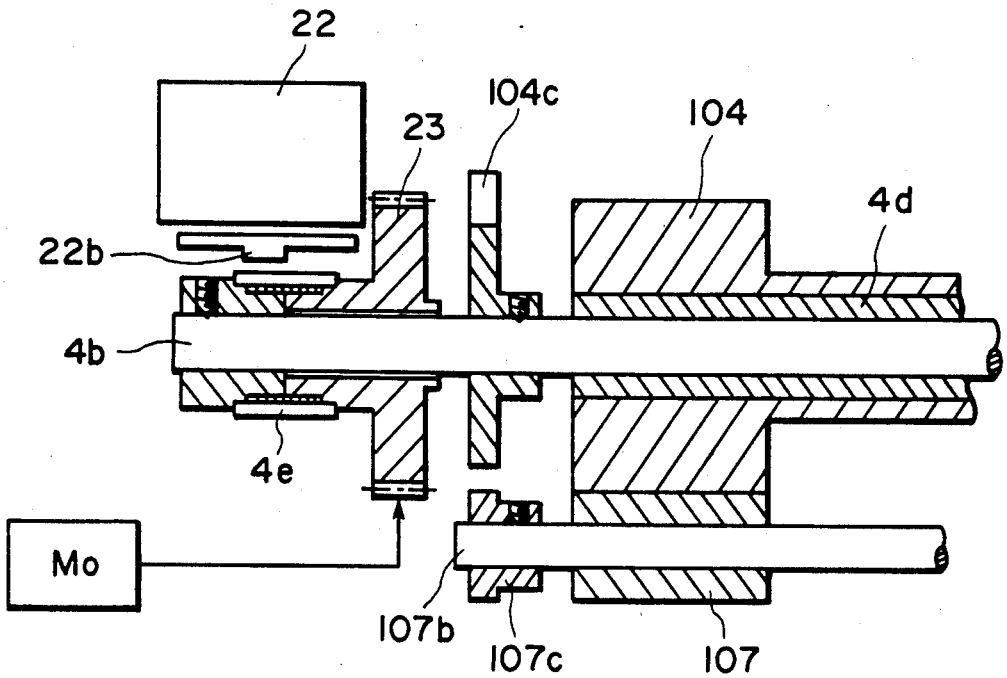
FIG. 9 is a longitudinal sectional view of a feeding roller of the apparatus of FIG. 8.
Figure 10:
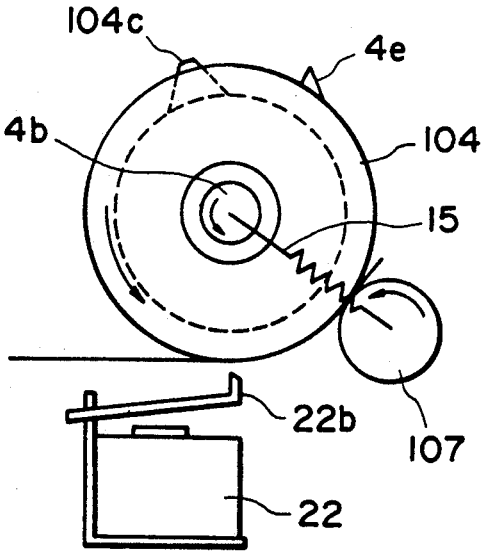
FIG. 10 is a sectional view of the feeding roller of the apparatus shown in FIG. 8, wherein the feeding roller is in contact with a roller.
Figure 11:
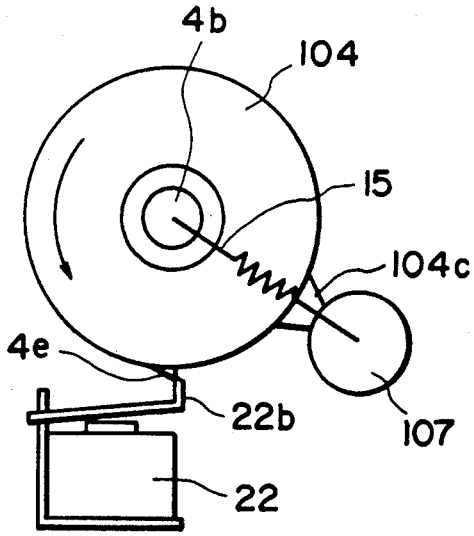
FIG. 11 is a sectional view of the feeding roller of the apparatus of FIG. 8 wherein the feeding roller is out of contact with the roller.

Referring to FIGS. 8 and 9, another embodiment of the present invention will be described. In this embodiment, the leading edge of the transfer material 1*a* reaches the point P in the same process as with the above described embodiment. Together with the movement of the transfer material 1*a* to the point P, a cam plate 104*c* mounted to the shaft 4*b* of the feeding roller 4 is rotating, and until the leading edge of the transfer material 1*a* reaches the point P, the feeding roller 104 and the roller 107 are kept in contact (FIG. 10). Immediately after the leading edge of the transfer material 1*a* reaches the point P, a control ring 4*e* is limited by a pawl 22*b* of a solenoid 22, as shown in FIG. 11 so that the cam plate 104*c* stops at a position where it is contacted to a spacer 107*c*. At this time, the input gear 23 is rotating, but the shaft 4*b* is not rotating. When the cam plate 104*c* is contacted to the roller 107, the feeding roller 104 and the roller 107 are disengaged. This state, referring back to FIG. 8, corresponds to the state wherein the roller 107 takes the position indicated by a reference 107'. With this state, the feeding roller 104 is mainly driven by a friction with the transfer material 1*a* at a point R. When the trailing edge of the transfer material 1*a* passes by the point R, the feeding roller 104 stops, whereby the next transfer material 1*b* is not fed out. This embodiment is particularly preferable when the intervals between a transfer material and the next transfer material are desired to be controlled accurately after the transfer materials are fed out.

Figure 12:
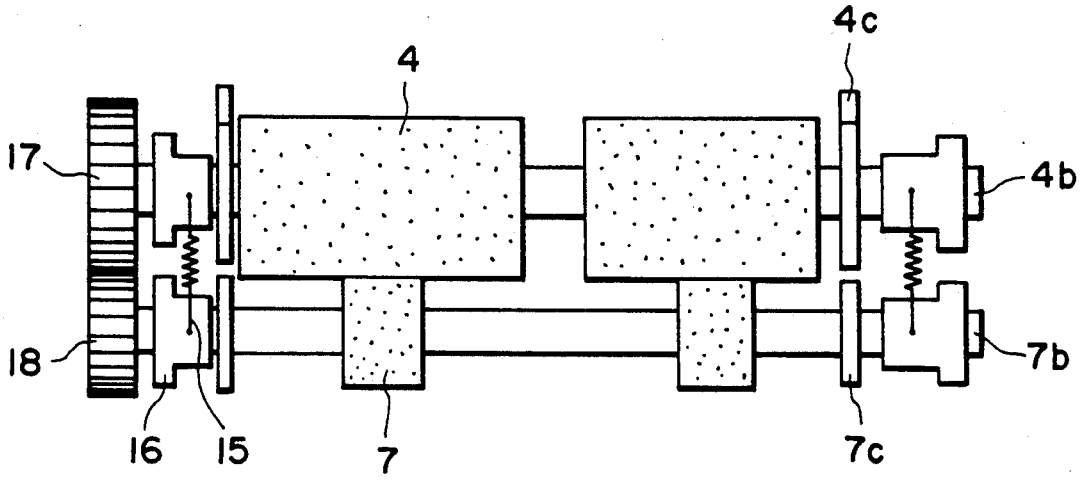
FIG. 12 is a longitudinal sectional view of a feeding roller used in a sheet feeding apparatus according to a further embodiment.

Referring to FIG. 12, a third embodiment of the present invention will be described. FIG. 12 is a longitudinal sectional view around a feeding roller of the feeding apparatus according to this embodiment. This embodiment is similar to the embodiment of FIG. 7A, but is additionally provided with gears 17 and 18. The rotation of the feeding roller 4 is transmitted to the roller 7 through the gears 17 and 18. The gear ratio is so determined that the peripheral speed of the feeding roller 4 and the roller 7 are substantially equal.

Figure 13:
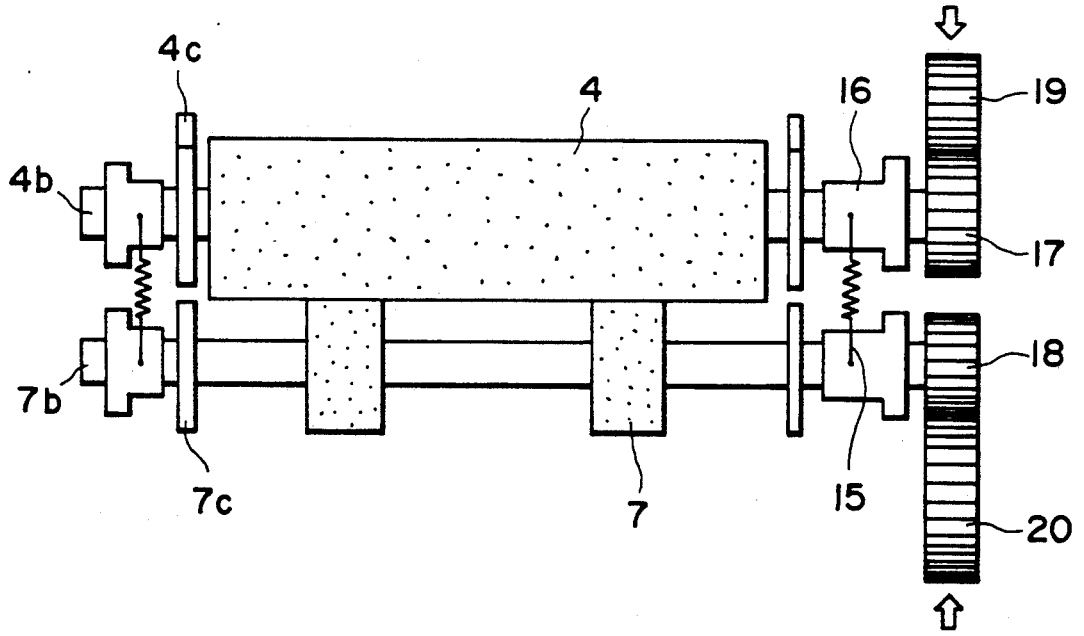
FIG. 13 is a longitudinal sectional view of a feeding roller of a sheet feeding apparatus according to a further embodiment of the present invention.

Referring to FIG. 13, there is shown a further embodiment. This Figure shows a longitudinal sectional view around a feeding roller of the sheet feeding apparatus according to this embodiment. This embodiment is similar to the embodiment described with FIG. 7A but is provided with gears 17, 19, 18 and 20. The rotation of the feeding roller 4 is transmitted from the gear 19 through the gear 17. On the other hand, the rotation of the roller 7 is transmitted from the gear 20 through the gear 18. In this embodiment, it is possible to change the peripheral speed of the feeding roller 4 and that of the roller 7 independently from each other.

Referring to FIGS. 14–16B a yet further embodiment of the present invention will be described. A number of transfer materials (cut sheets) 201 are stacked on a feeding tray 202, and the leading edge portions of the cut sheets 201 are urged to feeding rollers 214, 214' and idler rollers 215 and 215' by a supporting plate 213 rotatably supported and spring biased by a compression spring 203. The feeding rollers 214 and 214' are provided with portions having smaller diameters, respectively, so that at least one portion of a circumference of each of the feeding rollers 214 and 214' has a shape to provide an initializing position wherein it does not in contact with the cut sheet or the feeding roller 216 or 216' The feeding rollers 214 and 214' may have a length smaller than the minimum width of the sheet usable with this apparatus, and they are spaced apart longitudinally as shown in FIG. 15B. The feeding rollers 214 and 214' are fixed on a driving shaft 217 which is controlled by a spring clutch 218 and a solenoid 219 adjacent a longitudinal end thereof which is effective to provide a one turn rotation control.

Figure 14:
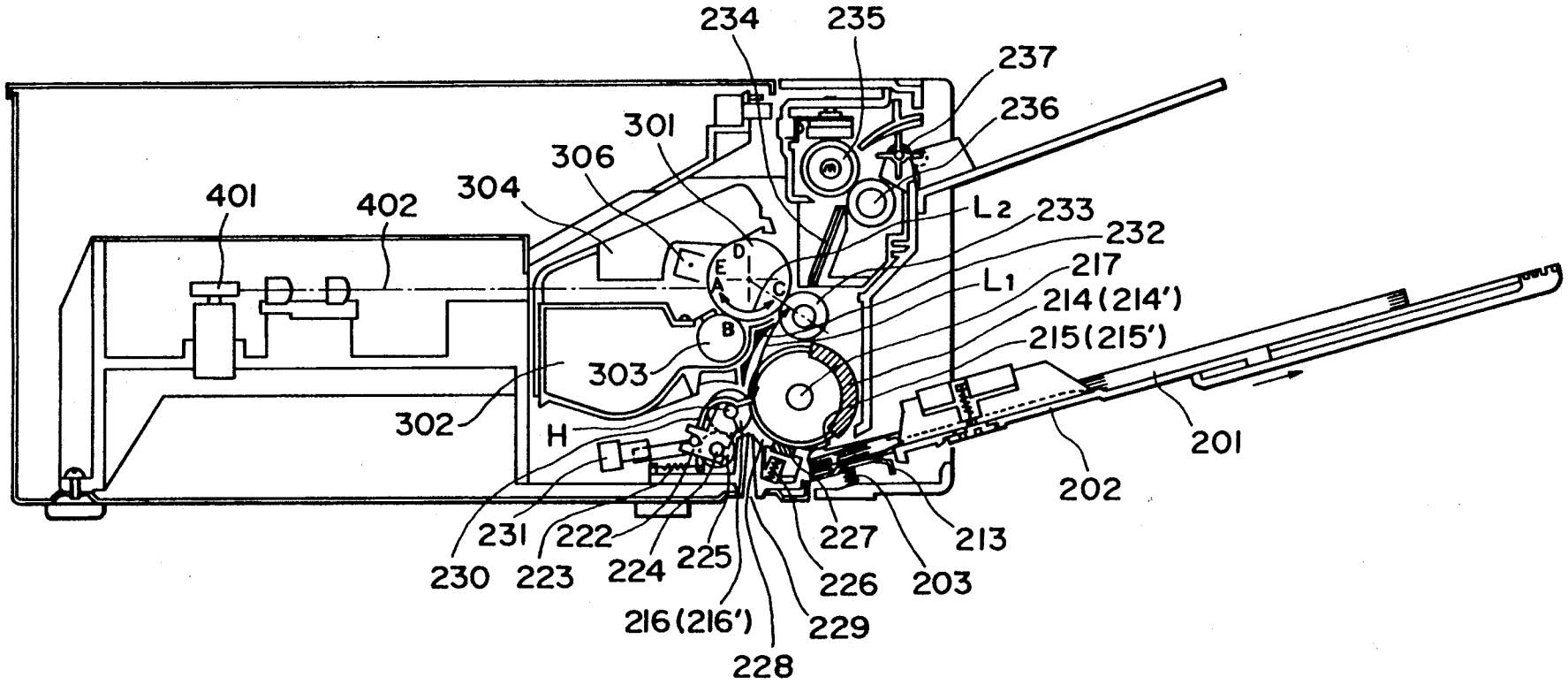
FIG. 14 is a sectional view of an image forming apparatus incorporating a sheet feeding apparatus according to a yet further embodiment of the present invention.
Figure 16A:
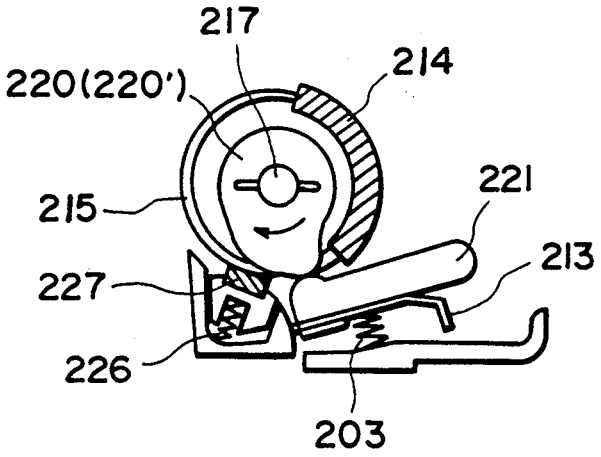
FIGS 16A and 16B are sectional views taken along D—D of FIG. 15A.

Outside the maximum width of the cut sheet usable with this apparatus, cam plates 220 and 220' are mounted to the driving shaft 217 to swing the supporting plate 213. The supporting plate 213 is provided with cam followers 221 and 221' corresponding to the cam plates 220 and 220'. Therefore, by the control of the rotation of the driving shaft 217, the supporting plate 213 moves substantially vertically so as to selectively urge the stacked cut sheets to the feeding rollers 214 and 214' and the idler rollers 215 and 215'. Because of this structure, when the operator loads the cut sheet into this apparatus, the supporting plate 213 takes a lower position as shown in FIG. 14 and FIG. 16A, thus allowing smooth loading of the cut sheets. Additionally, the operator is not required to perform an action of lowering the supporting plate 213. Adjacent outside longitudinal end of the feeding rollers 214 and 214', idler rollers 215 and 215' are mounted to the driving shaft 217 for smooth rotation relative to the driving shaft 217. The idler rollers 215 and 215' have a diameter which is slightly smaller than that of the feeding rollers 214 and 214', for example, by 0.5–1 mm.

The conveying rollers 216 and 216' are swingable about a drive input shaft 224 by a swinging arm 222, and is press-contacted to the idler rollers 215 and 215' by a spring 223 stretched between a frame of the apparatus and the conveying roller assembly. The driving force is applied to the conveying rollers 216 and 216' through a driving gear 225 fixedly mounted to the drive input shaft 224 and conveying gear fixedly mounted to the conveying rollers 216 and 216'. The driving and conveying gears are preferably disposed between conveying rollers 216 and 216' as in this embodiment, since then the application of the driving force does not result in an unbaranced pressing force of the conveying rollers, and therefore, the pressing force is stabilized.

Figure 15A:
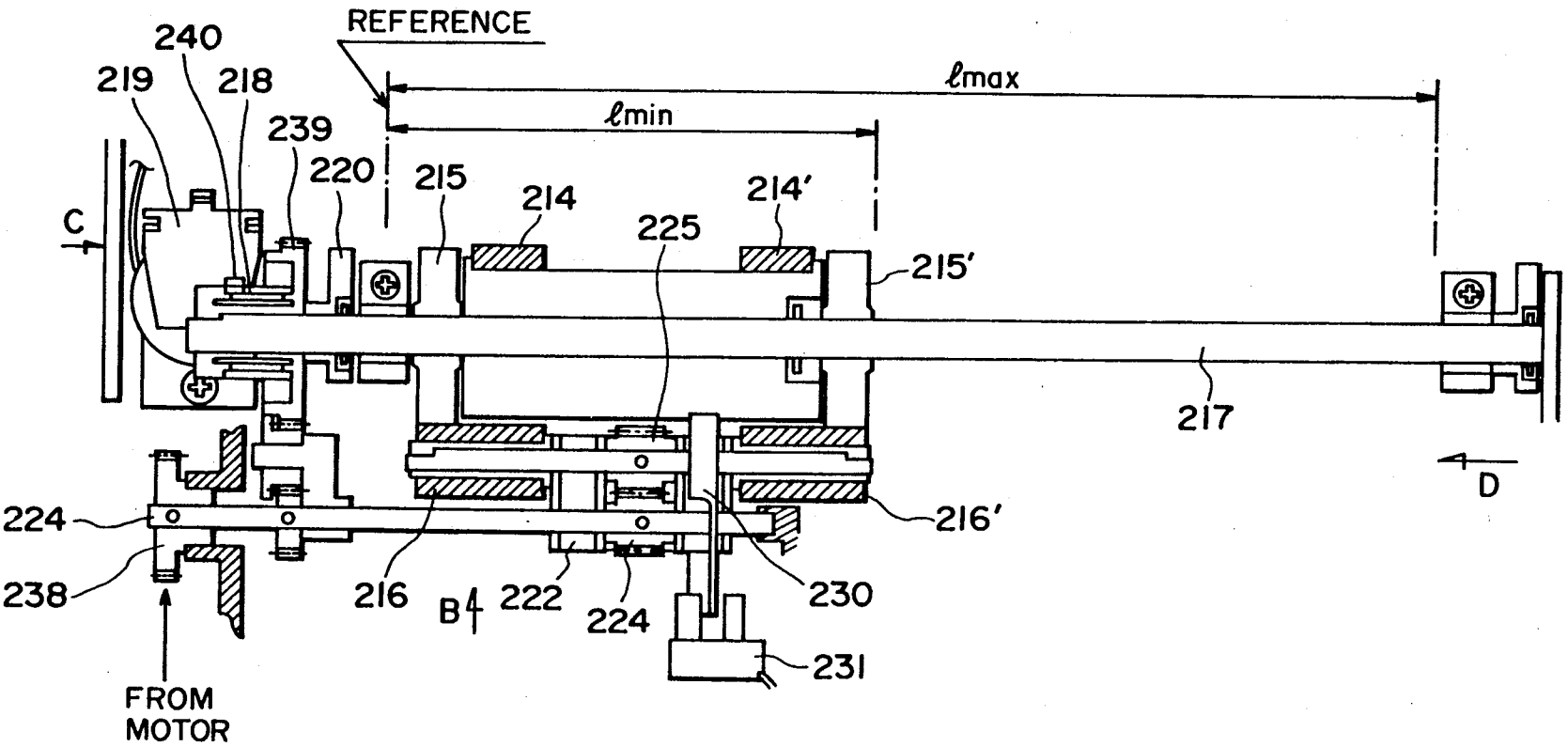
FIG. 15A illustrates a driving system for the sheet feeding apparatus of FIG. 14.
Figure 15B:
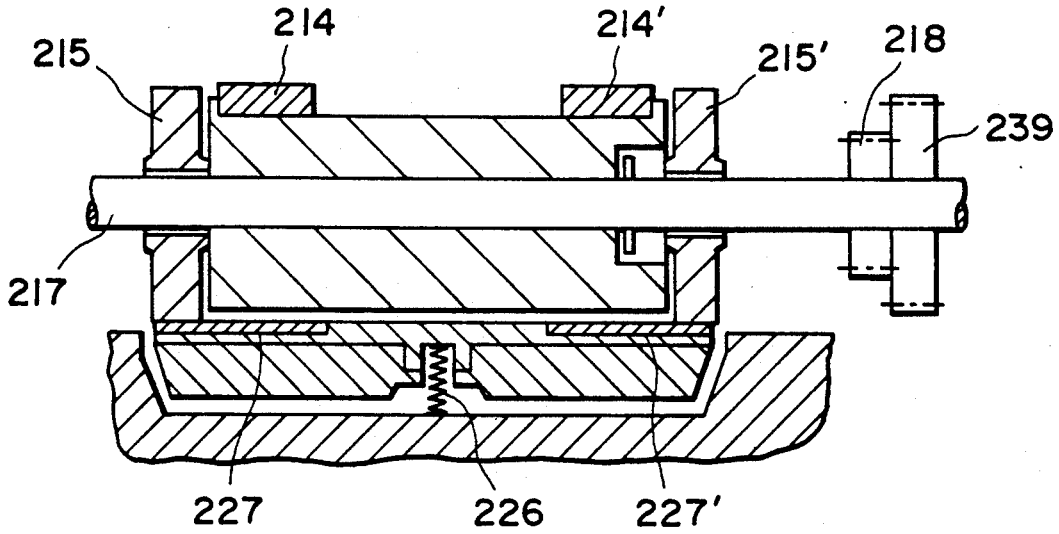
FIG. 15B is a sectional view taken along B—B of FIG. 15A.
Figure 15C:
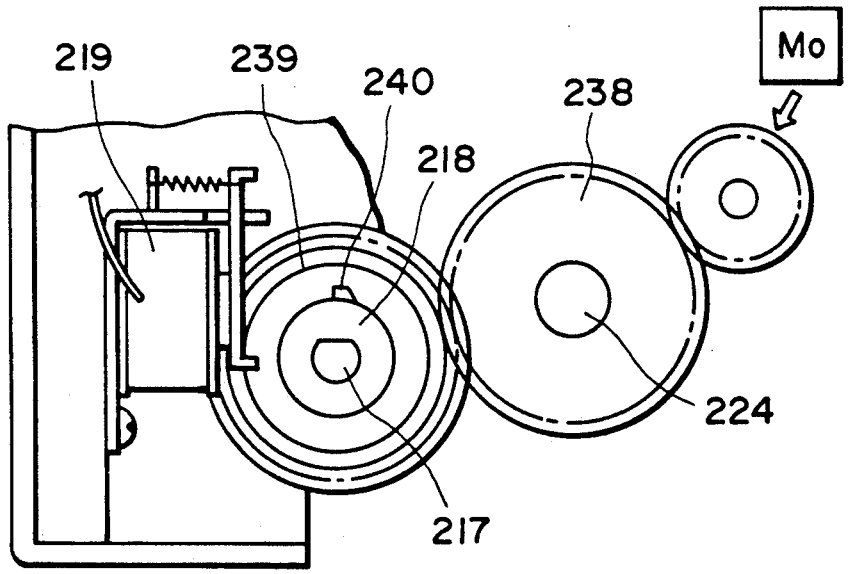
FIG. 15C is a sectional view taken along C—C of FIG. 15A.

To the feeding rollers 214 and 214' and idler rollers 215 and 215', a friction member is press-contacted to separate the cut sheet 201. The friction member is supported at its longitudinal center with a spring 226 for equalizing and pressing it to them. The separation member is in this embodiment separation pads 227 and 227' which is rubber material containing cork. The separation pads may be separated into two pads 227 and 227', as shown in FIG. 15B, if they exist corresponding to the feeding rollers 214 and 214' and idler rollers 215 and 215'. In this case, the portion not provided with the separation pad functions as a sheet guide 228 to guide the cut sheet to the conveying rollers 216 and 216'.

The sheet feeding apparatus according to this embodiment is provided with an additional or second cut sheet inlet 229 which is effective to introduce a cut sheet into the nips formed between the conveying rollers 216 and 216' and the idler rollers 215 and 215' from other than the feeding tray 202. Therefore, it is possible that an optional feeding means such as a sheet deck capable of accommodating a great number of cut sheets is disposed below the apparatus so as to feed the sheet from the feeding means to the second cut sheet inlet, and therefore, the apparatus is ready for expansion. The feeding roller 214 and the roller 215 are not necessarily coaxial, but may be parallel. The roller 214 and the roller 215 may have the same diameter Downstream of the nips formed between the conveying rollers 216 and 216' and the idler rollers 215 and 215', a sensor lever 230 is disposed, which is supported on a swingable arm 222 to detect the leading edge of the cut sheet with the aid of a photointerruptor 231. The sensor may otherwise be constructed by a transparent type or reflection type sensor other than the combination of the sensor lever 231 and the photointerruptor 239. After the cut sheet 201 actuates the sensor lever 203 by its leading edge, it is guided by a guiding portion 232 having a radius of curvature which is slightly larger than that of the feeding rollers 214 and 214', and is introduced into a nip formed between the photosensitive drum 301 and a transfer roller 233. The transfer roller 233 is of a semiconductor rubber to which a bias voltage of about 1 KV DC is applied, and is in contact with the photosensitive drum 301 to rotate therewith. The guiding portion 232 may preferably be constructed using a casing for the developing device 302 disposed below the photosensitive drum 301, since then the accuracy relative to the photosensitive drum 301 can be easily achieved, also since the number of parts is decreased with easiness of construction and with lower cost.

Around the photosensitive drum 301, there are an exposure station A for exposing the photosensitive drum 301 to a laser beam 402 from a laser scanning optical system 401 disposed at a left hand side of the apparatus as viewed in FIG. 14, a developing station B provided with a developing sleeve 303 for developing a latent image formed on said photosensitive drum 301 by the image exposure at the exposure station A, a transfer station C provided with a transfer roller 233, a cleaning station D provided with a cleaner 304 for cleaning the photosensitive drum 301 after a developed image has been transferred from the photosensitive drum 301 to the transfer sheet, and a primary charging station E provided with charging means such as a corona charger 306 for uniformly charging the photosensitive drum 301 before the imagewise exposure. By the cooperation of those stations, an image is formed on the transfer sheet. The cut sheet having received the toner image transferred thereonto at the transfer station C is introduced along a transportation guide which also functions as an inlet guide for an image fixing device. The image fixing device is provided with a heating roller 235 containing therein a heater and a pressing roll 236 made of a heat-resistive elastic member such as siicone rubber, which form a nip, into which the sheet is inserted. During the sheet passing through the nip, the image is fixed on the sheet. Thereafter, the sheet is discharged outside the image forming apparatus by a roller 237 disposed downstream of the fixing device and made of an elastic material such as rubber and NORSOREX (tradename, available from CDF CHIMIE, France) and having fins.

In operation, an unshown motor which is a driving source starts to rotate prior to the start of the sheet feeding operation. Then, a conveying roller driving gear 238 fixed to the drive input shaft 224 for the conveying rollers 216 and 216' starts to rotate, by which the rotation is transmitted to the conveying or transporting rollers 216 and 216' through the drive input shaft 224, the driving gear 225 and the conveying gear. Since the conveying rollers 216 and 216' are press-contacted to the idler rollers 215 and 215', respectively, the conveying rollers 216 and 216' and the idler rollers 215 and 215' are rotated together, respectively. At this time, even if the idler rollers 215 and 215' are in contact with the cut sheet 201, the cut sheet 201 is not fed since the frictional force between the cut sheet 201 and the separation pads 227 and 227' is larger than the frictional force between the idler rollers 215 and 215' and the cut sheet 201. However, in the stand-by state, as described hereinbefore, the supporting plate 213 takes a lower position by the cam plates 220 and 220' and the cam followers 221 and 221' so that the cut sheet does not contact the idler rollers 215 and 215'.

Figure 16B:
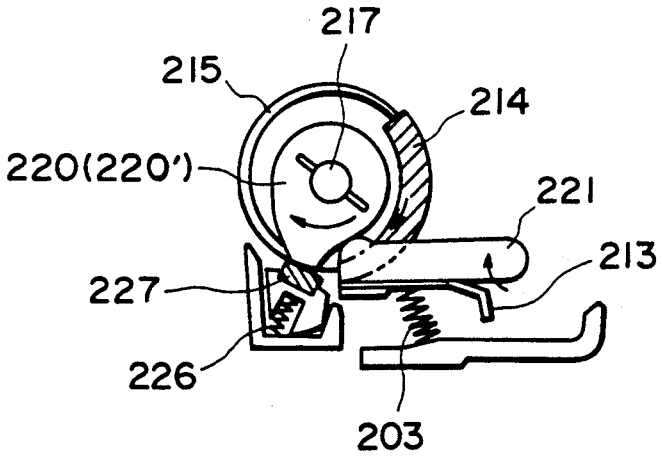

By the rotation of the conveying roller driving gear 238, a sheet feed driving gear 239 rotates which is connected through a spring clutch 218 to the driving shaft 217 for the feeding rollers 214 and 214'. When the solenoid 219 is not energized, the rotation of the feed driving gear 239 is not transmitted to the driving shaft 217. The spring clutch 218 is provided with a one turn controlling 240, so that a one turn drive transmission is performed in response to of/off pulse of the solenoid 219. When the solenoid 219 is energized in response to a feed start signal, the pawl of the control ring 240 is moved away, with the result that the driving force is transmitted from the feed driving gear 239 to the driving shaft 217 through the spring clutch 218. Then, the driving shaft 217 starts to rotate, and the cam plate 220 rotates so that the supporting plate 213 is urged upwardly by the spring 3, as shown in FIG. 16B. By this, the cut sheets stacked on the tray are urged to the feeding rollers 214 and 214' and to the idler rollers 215 and 215'. Even if the sheet is contacted to the rotating idler roller, the sheet is not fed out because the frictional force between the sheets is larger than the frictional force between the idler roller and the sheet. However, simultaneously with or slightly before or after the urging, that portion of the feeding rollers 214 and 214' which have a diameter larger than that of the idler rollers 215 and 215' come to contact to the cut sheet, by which the feeding rollers 214 and 214' feed the cut sheet out. Then, the cut sheet reaches the separation pad 227, where the relationship between the friction coefficients are as in the conventional, so that only the topmost sheet is conveyed to the downstream of the separation pad 227. Sooner or later, the cut sheet reaches the rotating conveying rollers 216 and 216', and thereafter, the conveying speed of the cut sheet is stabilized by the conveying rollers 216 and 216'. Then, the cut sheet reaches the detecting station H, where the leading edge of the sheet is detected, in response to which the image light starts onto the photosensitive member. By doing so, the cut sheet is continuously conveyed by the conveying rollers 216 and 216' without interruption. Therefore, it can be avoided that a shock resulting from actuation or deactuation of the registration roller is imposed on an image. In order that the laser image writing control is performed in response to the detection of the leading edge of the cut sheet, the length L1 of the sheet passage from the leading edge detecting position H to the transfer station C is longer than the peripheral length L2 of the photosensitive drum 301 from the image exposure station A to the transfer station C (L2<L1). When the leading edge of the sheet reaches the roller 233, it is detected by a detecting sensor or by a timer starting from the output of the sensor 230. Then, the solenoid 219 is operated to stop the roller 214. However, the roller 216 continues to rotate, whereas the roller 215 rotates idly, and therefore, the roller 215 does not put any burden to the sheet feeding by the roller 214.

Figure 17A:
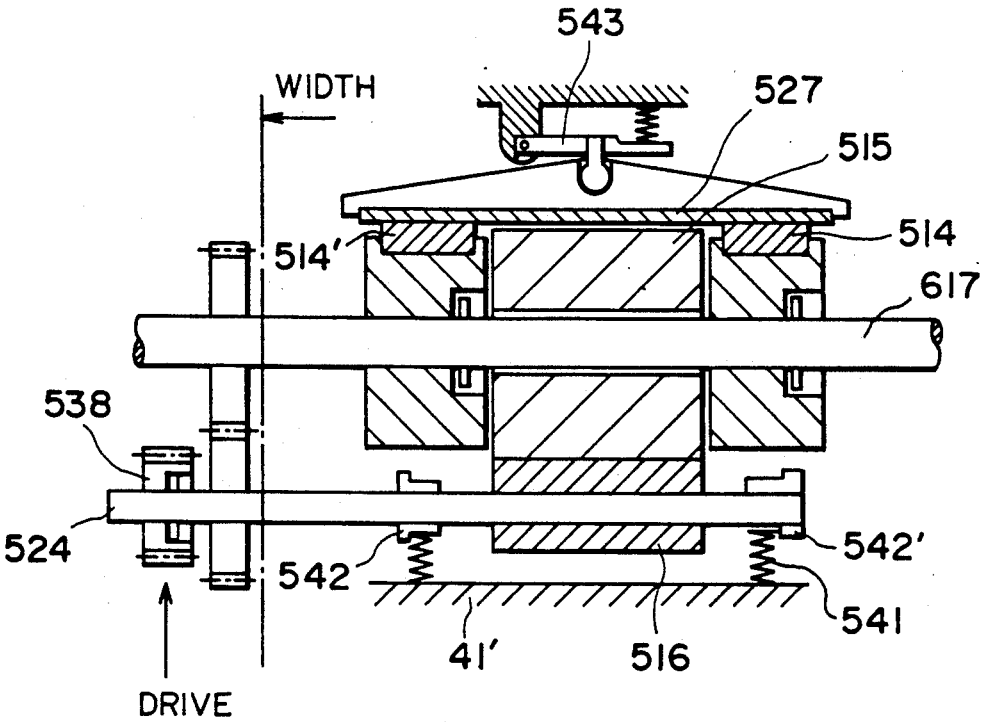
FIG. 17A shows a driving system for a sheet feeding apparatus according to a further embodiment of the present invention.
Figure 17B:
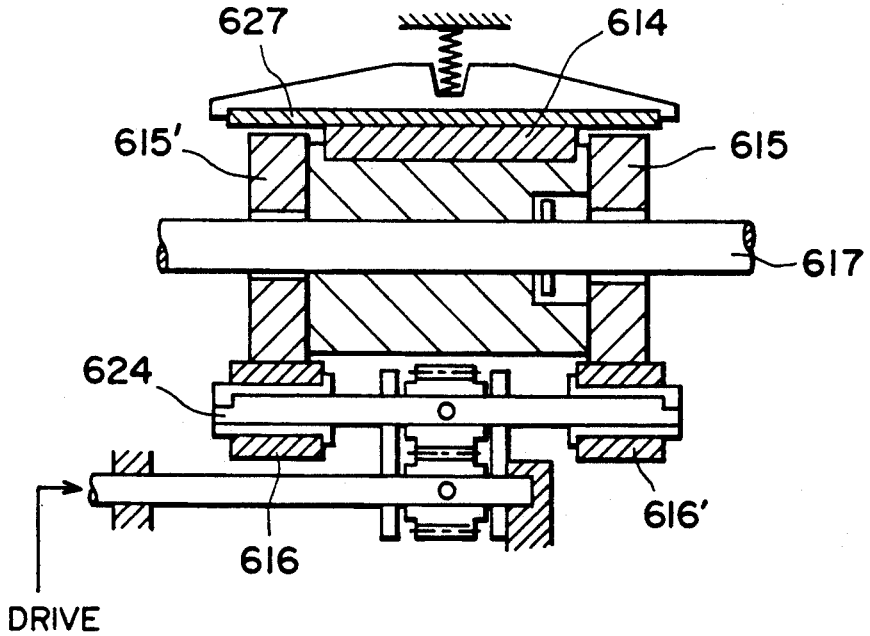
FIG. 17B shows a driving system for a sheet feeding apparatus according to a further object of the present invention.

If the sheet sensing position by the sensor lever 230 of the sheet leading edge sensor H is disposed adjacent an inside end of the minimum sheet width which is opposite to the reference position, a warning or prohibition can be performed when a user erroneously uses a sheet having a width smaller than the minimum usable width. As a result, it does not occur that the sheet having a width smaller than the minimum width reaches to the photosensitive drum. Also, the image writing on the photosensitive drum can be prevented, so that the damage and contamination to the drum can be minimized. Referring to FIGS. 17A and 17B, a further embodiment of the present invention will be described. In the foregoing embodiments, the sheet reference position is disposed at a lateral end, and on the basis of which the minimum width range and the maximum width range are determined. However, the present invention is not limited to this, and applicable to a central reference position feeding system. As shown in FIGS. 17A and 17B, the feeding rollers 514 and 514', idler rollers 515 and 515' and conveying rollers 516 and 516' may not be divided but may be continuous rollers.

In FIG. 17A, an idler roller 515 is disposed in the middle, whereas the feeding rollers 514 and 514' are disposed adjacent opposite ends of the idler roller 515, and a separation pad 527 is integral and is opposed both to the feeding rollers 514 and 514'. Also, the conveying roller 516 is an integral one roller. The conveying roller 516 is not swingable to be pressed to the idler roller 515, but it is urged through bearings 542 and 542' which are spring-biased by compression springs 541 and 541'. The conveying roller 516 receives a driving force from a driving gear 538. The separation pad 527 may be urged through a swingable arm 543. Or, as in this embodiment, the structure is such that the conveying roller 516 is contacted only to the idler roller. With such structures, the sheet is prevented from being conveyed while being gripped between the feeding rollers 514 and 514' and a conveying roller 516 which provide a strong conveying force, and therefore, production of paper dust can be prevented, and the conveying load can be decreased. The rotation of the gear 538 is transmitted from the shaft 624 to the shaft 617, similarly to the described above.

FIG. 17B is a modification of FIG. 17A structure. In this modification, the feeding roller 614 is disposed in the middle, whereas the idler rollers 615 and 615' are disposed adjacent the opposite ends of the feeding roller 614. An integral separation pad 627 is contacted to both to the idler rollers 615 and 615'. The conveying rollers 616 and 616' are disposed opposed to the idler rollers 615 and 615'. In this structure, the driving force and the pressure are applied in the middle position.

Figure 18A:
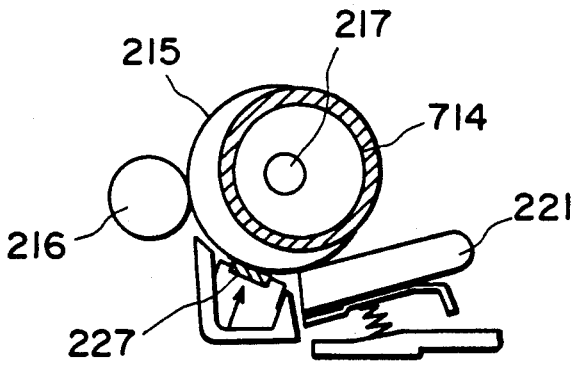
FIG. 18A is a cross-sectional view of a feeding roller of a sheet feeding apparatus according to a further embodiment of the present invention.
Figure 18B:
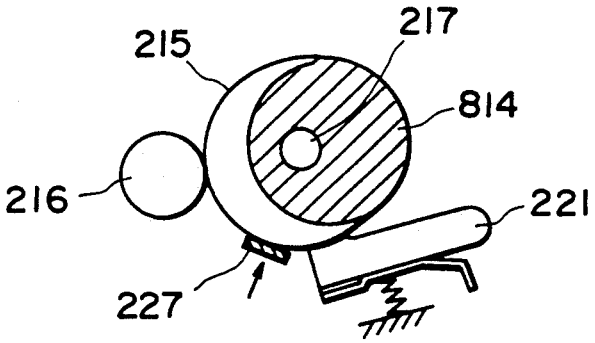
FIG. 18B is a cross-sectional view of a feeding roller of a sheet feeding apparatus according to a further embodiment of the present invention.
Figure 18C:
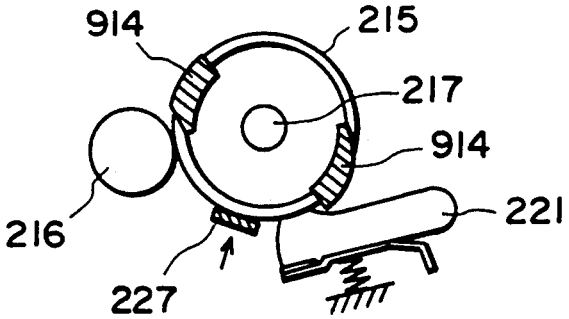
FIG. 18C is a cross-sectional view of a feeding roller of a sheet feeding apparatus according to a further embodiment of the present invention.

Referring to FIGS. 18A, 18B and 18C, there are shown further embodiments. In FIG. 18A, a circular rubber member 714 is eccentrically fixed on the driving shaft 717. With this structure, the manufacturing is easy, and the contact between the cut sheet and the pad or the like is continuous and smooth. In FIG. 18B, a cam member 814 made of rubber material is employed which has a continuously increasing diameter. Also, with the structure, the contact between the cut sheet and the pad or the like is smooth. In FIG. 18C, the control of the feeding roller 914 is not one-rotation control, but is a half-turn control.

Figure 19:
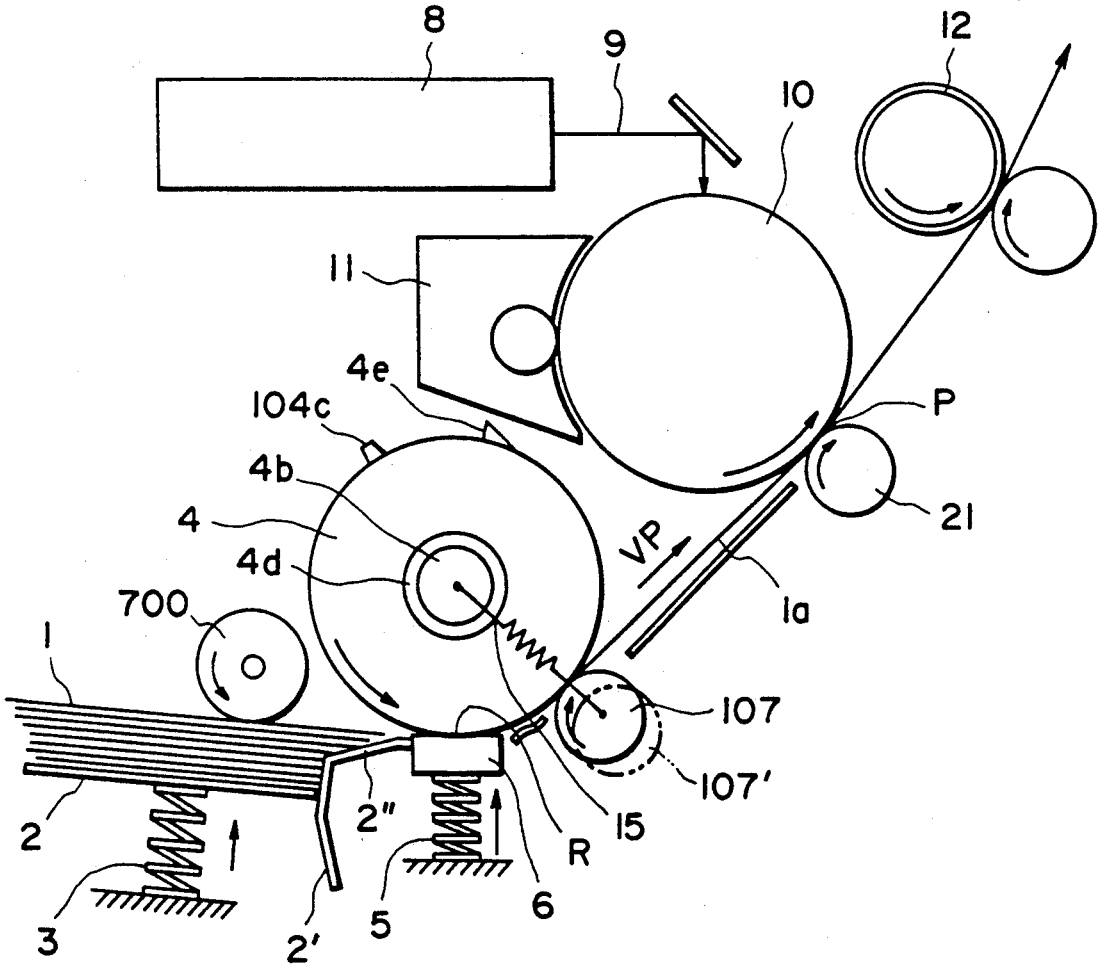
FIG. 19 is a sectional view of a sheet feeding apparatus according to a further embodiment of the present invention.
Figure 20:
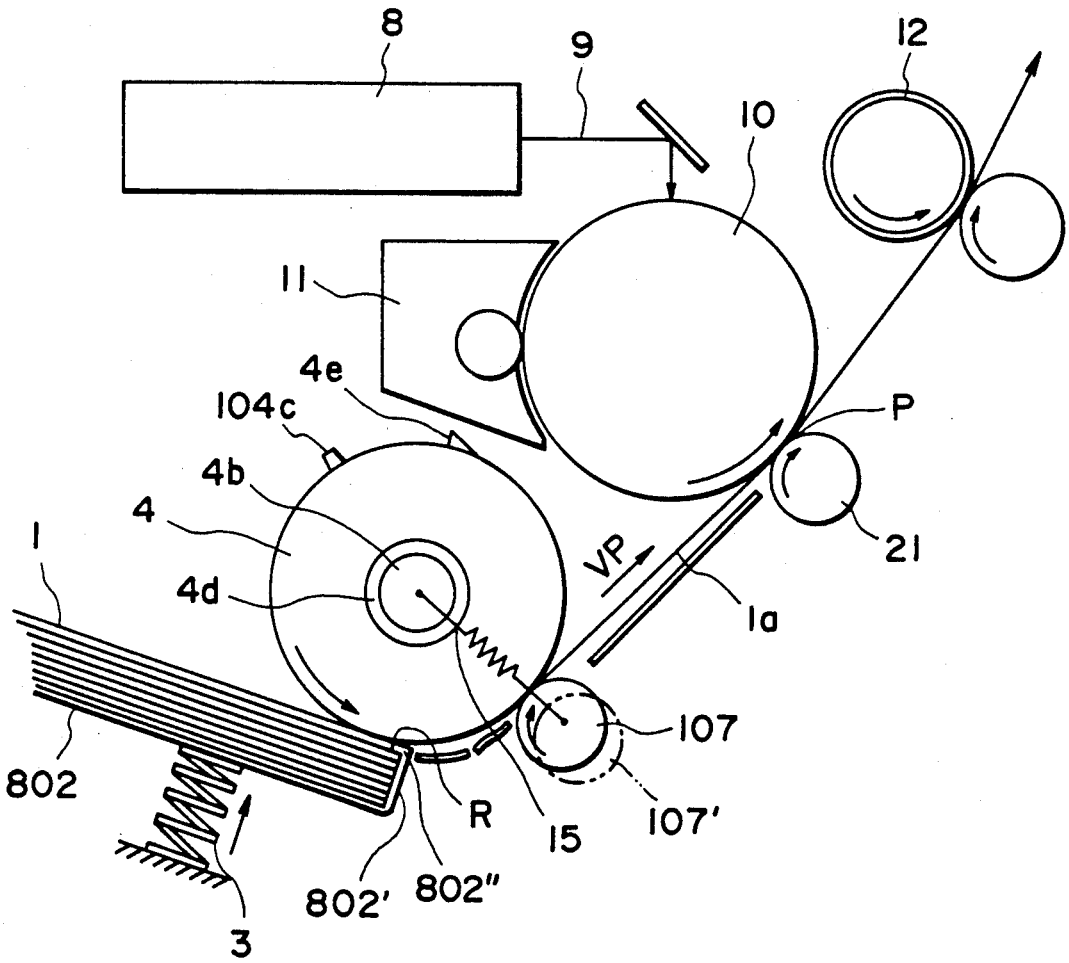
FIG. 20 is a sectional view of a sheet feeding apparatus according to a further embodiment of the present invention.

FIGS. 19 and 20 show a yet further embodiments. In FIG. 19, an auxiliary roller 700 is used in addition to the roller 4. In this structure, each two or three sheet materials are separated from the stack on the feeding tray 2, and subsequently one sheet is separated out by the cooperation between the roller 4 and the pad 6. An inclined guide 2" is coated with friction resistance member.

In FIG. 20, separation pawls 802' is provided in the feeding tray 802, and by the cooperation between the roller 4 and the separation pawl 802", the sheet materials are separated one by one from the tray 802.

In place of the roller 4, a belt is usable, and the stacked sheets may be separated from the bottom.

While the invention has been described with reference to the structures disclosed herein, it is not confined to the details set forth and this application is intended to cover such modifications or changes as may come within the purposes of the improvements or the scope of the following claims.

What is claimed is:

1. A sheet feeding apparatus comprising:

a first rotatable member, having a feeding portion for contacting to and applying feeding force to a sheet material of a stack of sheet materials and a nonfeeding portion not applying the feeding force thereto;

a second rotatable member disposed co-axially with said first rotatable member, and having a diameter smaller than that of said feeding portion and larger than said non-feeding portion;

separating means for cooperating with said first rotatable member to allow one sheet of material to be fed; and a third rotatable member for cooperating with said first rotatable member to transport the sheet material separated by said separating means;

wherein in a stand-by state prior to feeding operation, said second rotatable member contacts said separating means and said third rotatable member.

2. An apparatus according to claim 1, wherein in a stand-by state prior to the sheet material feeding operation, said second rotatable member contacts resiliently to said separating means and said third rotatable member.

3. An apparatus according to claim 1, further comprising a driving source for driving said third rotatable member and clutching means provided between said driving source and said first rotatable member, wherein after said first rotatable member stops, the sheet material is transported by cooperation between said third rotatable member and said second rotatable member.

4. An apparatus according to claim 1, further comprising means for stacking the sheet materials, wherein said first rotatable member is actable on the topmost sheet material of the stack.

5. An apparatus according to claim 1, wherein said first rotatable member is connected to a driving source, and wherein said third rotatable member is a follower rotatable member.

6. An apparatus according to claim 1, wherein the sheet material becomes out of contact with said first rotatable member during it being transported by said second rotatable member and said third rotatable member.

7. An apparatus according to claim 6, further comprising a fourth rotatable member which is co-axial with, but rotatable independently from, said first rotatable member and has a diameter smaller than the sheet feeding portion of said first rotatable member and larger than the non-feeding portion thereof, wherein said first rotatable member is dispose between said second and fourth rotatable member.

8. A sheet feeding apparatus comprising:

a feeding rotatable member contactable to stacked sheet materials to feed the sheet materials therefrom;

separation means for cooperating with said feeding rotatable member to allow the sheet materials to be fed one sheet material at a time;

a transporting rotatable member for cooperating with said feeding rotatable member to transport the sheet materials separated by said separating means;

a first passage for feeding the stacked sheet materials to between said feeding rotatable member and said transporting rotatable member by way of said separating means; and a second passage for feeding a sheet material to between said transporting rotatable member and said feeding rotatable member not by way of said separating means, wherein the sheet material is fed by cooperation between said transporting member and said feeding rotatable member.

9. An apparatus according to claim 8, wherein said transporting rotatable member is driven by the sheet material being fed by said feeding rotatable member.

10. An apparatus according to claim 8, wherein said feeding rotatable member includes a sheet feeding portion contactable to the sheet material to apply feeding force thereto and a non-feeding portion not applying the feeding force to the sheet.

11. An apparatus according to claim 10, further comprising a second rotatable member which is co-axial with, but rotatable independently from, said feeding rotatable member and has a diameter smaller than the sheet feeding portion of said feeding rotatable member and larger than the non-feeding portion thereof.

12. An apparatus according to claim 11, wherein said transporting rotatable member is cooperable with said second rotatable member to transport the sheet material.

13. An apparatus according to claim 12, wherein said separating means is contactable with the feeding portion of said feeding rotatable member, directly or through the sheet material, and is not contactable with the non-feeding portion.

14. An apparatus according to claim 13, wherein when said separating means is not in contact with the feeding portion, the sheet material is separated by cooperation of said second rotatable member and said separating means.

15. A sheet feeding apparatus, comprising:

sheet accommodating means for accommodating sheet materials;

a first rotatable member having a sheet feeding portion contactable to the sheet material accommodated in said sheet accommodating means to apply feeding force thereto and a non-feeding portion not applying the feeding force to the sheet;

a second rotatable member which is co-axial with, but rotatable independently from, said first rotatable member and has a diameter smaller than the sheet feeding portion of said first rotatable member and larger than the non-feeding portion thereof;

separating means cooperable with said first rotatable member and said second rotatable member to separate one of the sheet materials from the sheet materials in said sheet accommodating means; and a third rotatable member cooperable with said second rotatable member to form a nip for receiving said one of the sheet materials and applying thereto force to transport it, wherein when said one of the sheet materials is transported by the nip the non-feeding portion of said first rotatable member is faced to said one of the sheet materials with the feeding portion thereof out of contact therewith.

16. An apparatus according to claim 15, further comprising a resilient member for resiliently urging said accommodating means toward said first rotatable member.

17. An apparatus according to claim 15, wherein a fourth rotatable member which is co-axial with, but rotatable independently from said first rotatable member and has a diameter smaller than the sheet feeding portion of said first rotatable member and larger than the non-feeding portion thereof, wherein said first rotatable member is disposed between said second and fourth rotatable member.

18. An apparatus according to claim 15, wherein said separating means is contactable with the feeding portion of said first rotatable member, directly or through the sheet material, and is not contactable with the non-feeding portion.

19. An apparatus according to claim 18, wherein said separating means is out of contact with said second rotatable member when the feeding portion is in contact with the sheet material, but is contactable with said second rotatable member when said feeding portion is out of contact with the sheet material.

20. An apparatus according to claim 15, further comprising driving means for driving said third rotatable member.

21. An apparatus according to claim 20, wherein said driving means also drives said first rotatable member.

22. A sheet feeding apparatus, comprising:

sheet accommodating means for accommodating sheet materials;

a first rotatable member having a sheet feeding portion contactable to the sheet material accommodated in said sheet accommodating means to apply feeding force thereto and a non-feeding portion not applying the feeding force to the sheet;

a second rotatable member which is co-axial with, but rotatable independently from, said first rotatable member and has a diameter smaller than the sheet feeding portion of said first rotatable member and larger than the non-feeding portion thereof;

separating means cooperable with said first rotatable member and said second rotatable member to separate one of the sheet materials from the sheet materials in said sheet accommodating means; and a third rotatable member cooperable with said second rotatable member to form a nip for receiving said one of the sheet materials and applying thereto force to transport it without interruption;

image forming means for forming an image on the sheet material transported by said third rotatable member; and wherein said third rotatable member transports the sheet material directly to said image forming means, and a distance between said image forming means and said third rotatable member is shorter than a length of the sheet material.

23. An apparatus according to claim 22, further comprising a resilient member for resiliently urging said accommodating means toward said first rotatable member.

24. An apparatus according to claim 22, further comprising a fourth rotatable member which is co-axial with, but rotatable independently from, said first rotatable member and has a diameter smaller than the sheet feeding portion of said first rotatable member and larger than the non-feeding portion thereof, wherein said first rotatable member is disposed between said second and fourth rotatable member.

25. An apparatus according to claim 22, wherein said separating means is contactable with the feeding portion of said first rotatable member, directly or through the sheet material, and is not contactable with the non-feeding portion.

26. An apparatus according to claim 25, wherein said separating means is out of contact with said second rotatable member when the feeding portion is in contact with the sheet material, but is contactable with said second rotatable member when said feeding portion is out of contact with the sheet material.

27. An apparatus according to claim 22, further comprising driving means for driving said third rotatable member.

28. An apparatus according to claim 27, wherein said driving means also drives said first rotatable member.

29. An apparatus according to claim 27, wherein said first rotatable member and the third rotatable member are driven by a common driving source.

30. An image forming apparatus, comprising:

a first rotatable member, having a feeding portion for contact with and applying feeding force to a sheet material of a stack of sheet materials and a non-feeding portion not applying the feeding force thereto;

a second rotatable member disposed co-axially with said first rotatable member, and having a diameter smaller than that of said feeding portion and larger than said non-feeding portion;

separating means for cooperating with said first rotatable member to allow one sheet of material to be fed;

a third rotatable member for cooperating with said first rotatable member to transport the sheet material separated by said separating means; and image forming means for forming an image on the sheet conveyed by said third rotatable member;

wherein in a stand-by state prior to feeding operation, said second rotatable member contacts to said separating means and said third rotatable member.

31. An image forming apparatus, comprising:

a feeding rotatable member contactable to stacked sheet materials to feed the sheet materials therefrom;

separation means for cooperation with said feeding rotatable member to allow the sheet materials to be fed one sheet material at a time;

a transporting rotatable member for cooperating with said feeding rotatable member to transport the sheet materials separated by said separation means;

a first passage for feeding the stacked sheet materials to between said feeding rotatable member and said transporting rotatable member by way of said separating means;

a second passage for feeding a sheet material to between said transporting rotatable member and said feeding rotatable member not by way of said separating means, wherein the sheet material is fed by cooperation between said transporting rotatable member and said feeding rotatable member; and image forming means for forming an image on the sheet material conveyed by said transporting rotatable member and said feeding rotatable member.

* * * * *

UNITED STATES PATENT AND TRADEMARK OFFICE

CERTIFICATE OF CORRECTION

PATENT NO. : 5,186,448

DATED : February 16, 1993

INVENTOR(S) : Ichiro Ohsawa, et al

It is certified that error appears in the above-indentified patent and that said Letters Patent is hereby corrected as shown below:

ON THE TITLE PAGE,

[56] REFERENCES CITED

"59-139161" should read --59-31225--.

COLUMN 1

Line 28, "$\mu_1$ $\mu_2$," should read --$\mu_1 < \mu_2$--.

Line 36, "varies" should read --vary--.

COLUMN 2

Line 1, "$\mu_3$ the" should read --$\mu_3$ between the--.

COLUMN 4

Line 1, "is" should read --are--.

COLUMN 6

Line 32, "end" should read --ends--.

Line 50, "unbaranced" should read --unbalanced--.

Line 58, "is" should read --are--.

UNITED STATES PATENT AND TRADEMARK OFFICE

CERTIFICATE OF CORRECTION

PATENT NO. : 5,186,448

DATED : February 16, 1993

INVENTOR(S) : Ichiro Ohsawa, et al

It is certified that error appears in the above-indentified patent and that said Letters Patent is hereby corrected as shown below:

COLUMN 8

Line 36, "spring 3," should read --spring 203,--.

COLUMN 10

Line 7, "a" should be deleted.

Line 14, "is" should read --are--.

COLUMN 11

Line 9, "dispose" should read --disposed--.

Line 20, "separating" should read --separation--.

COLUMN 12

Line 12, "nip" should read --nip,--.

Signed and Sealed this

Twenty-fifth Day of October, 1994

*Attest:*

*Attesting Officer*

Bruce Lehman

BRUCE LEHMAN

*Commissioner of Patents and Trademarks*